US006681946B1

(12) United States Patent
Jansen et al.

(10) Patent No.: US 6,681,946 B1
(45) Date of Patent: Jan. 27, 2004

(54) RESEALABLE MEDICAL TRANSFER SET

(75) Inventors: Hubert Jansen, Jarrie (FR); Jean-Claude Thibault, Saint Egreve (FR)

(73) Assignee: Becton, Dickinson and Company, Franklin Lakes, NJ (US)

( * ) Notice: Subject to any disclaimer, the term of this patent is extended or adjusted under 35 U.S.C. 154(b) by 276 days.

(21) Appl. No.: 09/665,859

(22) Filed: Sep. 20, 2000

Related U.S. Application Data

(63) Continuation-in-part of application No. 09/168,502, filed on Oct. 8, 1998, now Pat. No. 6,382,442, which is a continuation-in-part of application No. 09/454,453, filed on Dec. 6, 1999, now Pat. No. 6,189,580, which is a continuation of application No. 09/031,302, filed on Feb. 26, 1998, now Pat. No. 6,003,566.

(60) Provisional application No. 60/082,372, filed on Apr. 20, 1998.

(51) Int. Cl.[7] ..... B65D 39/00; B65D 41/10; B65D 47/04

(52) U.S. Cl. ..... 215/249; 141/329; 215/247; 215/251; 215/258; 215/274; 215/324; 215/DIG. 3; 604/411; 604/415; 604/416

(58) Field of Search ..... 141/25, 329, 21–27, 141/330; 604/403, 406, 411–416; 215/247, 258, 307, 355, DIG. 3, 249, 295–297, 308; 222/81, 83, 83.5

(56) References Cited

U.S. PATENT DOCUMENTS 37,221 A 12/1862 Dunton
659,519 A 5/1900 De Oliveria (List continued on next page.)

FOREIGN PATENT DOCUMENTS

EP 0 236 127 A2 3/1987
EP 0 406 374 B1 12/1989

(List continued on next page.)

OTHER PUBLICATIONS

German Patent No. DE 36 18 158 A1, May 30, 1986.
Swiss Patent No. 501 172, Dec. 31, 1970.

(List continued on next page.)

*Primary Examiner*—Nathan J. Newhouse
*Assistant Examiner*—Niki M. Eloshway
(74) *Attorney, Agent, or Firm*—Hoffmann & Baron, LLP

(57) ABSTRACT

A transfer set for transferring fluid, including drugs, vaccines, medicaments, solutions and the like, between a first container, such as a conventional vial, and a second container, such as a conventional syringe having a unique multipurpose resealable member. The transfer set assembly includes an elastomeric tubular fluid transfer and resealable valve member preferably including an open end mounted on the pierceable closure or stopper of a vial and a generally closed distal end having a longitudinal slit and a piercing member is telescopically received within the fluid transfer valve member having a piercing end opposite the pierceable closure. The fluid transfer valve member is preferably formed of silicone and is surrounded by a generally tubular luer connector member having an open end mounted on the pierceable closure and a distal end having male luer threads. This assembly is enclosed within a cup-shaped closure and the assembly is retained to the first container or vial by a collar preferably secured to the vial by crimping. Upon removal of the cup-shaped closure, fluid communication between the vial and a second container, such as a syringe, is achieved by threading the luer connector of the syringe on the luer threads of the tubular luer connector member, which drives the tip through the slit of the elastomeric fluid transfer valve member against the distal end of the piercing member, driving the piercing end through the pierceable closure. In the preferred embodiment, the piercing member includes a generally longitudinal channel which establishes communication between the vial and the syringe through the tubular fluid transfer valve member.

27 Claims, 3 Drawing Sheets

U.S. PATENT DOCUMENTS

| | | | |
|---|---|---|---|
| 2,342,215 | A | 2/1944 | Perelson |
| 2,388,634 | A | 11/1945 | De Woody |
| 2,524,365 | A | 10/1950 | Smith |
| 2,607,503 | A | 8/1952 | Sonnenberg |
| 2,653,609 | A | 9/1953 | Smith |
| 2,659,370 | A | 11/1953 | Smith |
| 2,667,986 | A | 2/1954 | Perelson |
| 2,953,132 | A | 3/1960 | Richter et al. |
| 3,033,202 | A | 5/1962 | Richter et al. |
| 3,164,303 | A | 1/1965 | Trautmann |
| 3,206,080 | A | 9/1965 | Scislowicz |
| 3,278,063 | A | 10/1966 | Kranzhoff |
| 3,356,093 | A | 12/1967 | Monahon |
| 3,357,427 | A | 12/1967 | Wittke et al. |
| 3,610,297 | A | 10/1971 | Raaf et al. |
| 3,674,028 | A | 7/1972 | Ogle |
| 3,779,371 | A | 12/1973 | Rovinksi |
| 3,810,469 | A | 5/1974 | Hurschman |
| 3,826,260 | A | 7/1974 | Killinger |
| 3,838,689 | A | 10/1974 | Cohen |
| 3,872,992 | A | 3/1975 | Larson |
| 3,940,003 | A | 2/1976 | Larson |
| 3,977,555 | A | 8/1976 | Larson |
| 3,995,630 | A | 12/1976 | van de Veerdonk |
| 4,020,839 | A | 5/1977 | Klapp |
| 4,048,999 | A | 9/1977 | Kobel |
| 4,067,440 | A | 1/1978 | Lataix |
| 4,153,057 | A | 5/1979 | Kobel |
| 4,187,893 | A | 2/1980 | Bujan |
| 4,210,255 | A | 7/1980 | Pan |
| 4,296,786 | A | 10/1981 | Brignola |
| 4,336,891 | A | 6/1982 | Smith |
| 4,387,879 | A | 6/1983 | Tauschinski |
| 4,412,623 | A | 11/1983 | Schmidt |
| 4,418,827 | A | 12/1983 | Butterfield |
| 4,425,120 | A | 1/1984 | Sampson et al. |
| 4,460,735 | A | 7/1984 | Froix |
| 4,493,348 | A | 1/1985 | Lemmons |
| 4,505,709 | A | 3/1985 | Froning et al. |
| 4,507,113 | A | 3/1985 | Dunlap |
| 4,564,054 | A | 1/1986 | Gustavsson |
| 4,573,506 | A | 3/1986 | Paoletti |
| 4,573,976 | A | 3/1986 | Sampson et al. |
| 4,576,211 | A | 3/1986 | Valentini et al. |
| 4,588,403 | A | 5/1986 | Weiss et al. |
| 4,619,651 | A | 10/1986 | Kopfer et al. |
| 4,624,393 | A | 11/1986 | Lopez |
| 4,639,250 | A | 1/1987 | Rycroft |
| 4,662,878 | A | 5/1987 | Lindmayer |
| 4,672,996 | A | 6/1987 | Floyd et al. |
| 4,673,404 | A | 6/1987 | Gustavsson |
| 4,675,020 | A | 6/1987 | McPhee |
| 4,792,053 | A | 12/1988 | Towne et al. |
| 4,822,351 | A | 4/1989 | Purcell |
| 4,826,491 | A | 5/1989 | Schramm |
| 4,834,149 | A | 5/1989 | Fournier et al. |
| 4,834,152 | A | 5/1989 | Howson et al. |
| 4,850,994 | A | 7/1989 | Zerbet et al. |
| 4,884,703 | A | 12/1989 | O'Meara |
| 4,909,290 | A | 3/1990 | Coccia |
| 4,913,945 | A | 4/1990 | Maruhashi et al. |
| 4,923,447 | A | 5/1990 | Morgan |
| 4,927,423 | A | 5/1990 | Malmborg |
| 4,932,937 | A | 6/1990 | Gustavsson et al. |
| 4,944,736 | A | 7/1990 | Holtz |
| 4,982,740 | A | 1/1991 | Broden |
| 5,006,118 | A | 4/1991 | Yule |
| 5,024,256 | A | 6/1991 | Vadjer |
| 5,035,689 | A | 7/1991 | Schroeder |
| 5,060,812 | A | 10/1991 | Ogle, II |
| 5,088,996 | A | 2/1992 | Kopfer et al. |
| 5,092,840 | A | 3/1992 | Healy |
| 5,116,326 | A | 5/1992 | Schmidt |
| 5,169,385 | A | 12/1992 | Turnball |
| 5,171,214 | A | 12/1992 | Kolber et al. |
| 5,215,538 | A | 6/1993 | Larkin |
| 5,217,433 | A | 6/1993 | Bunin |
| 5,232,029 | A | 8/1993 | Knox et al. |
| 5,232,109 | A | 8/1993 | Tirrell et al. |
| 5,250,037 | A | 10/1993 | Bitdinger |
| 5,275,299 | A | 1/1994 | Konrad et al. |
| 5,279,576 | A | 1/1994 | Loo et al. |
| 5,291,991 | A | 3/1994 | Meyer |
| 5,297,599 | A | 3/1994 | Bucheli |
| 5,342,319 | A | 8/1994 | Watson et al. |
| 5,348,548 | A | 9/1994 | Meyer et al. |
| 5,350,372 | A | 9/1994 | Ikeda et al. |
| 5,352,196 | A | 10/1994 | Haber et al. |
| 5,358,501 | A | 10/1994 | Meyer |
| 5,360,413 | A | 11/1994 | Leason et al. |
| 5,364,386 | A | 11/1994 | Fukuoka et al. |
| 5,385,546 | A | 1/1995 | Kriesel et al. |
| 5,397,303 | A | 3/1995 | Sancoff et al. |
| 5,409,125 | A | 4/1995 | Kimber et al. |
| 5,411,499 | A | 5/1995 | Dudar et al. |
| 5,415,374 | A | 5/1995 | Carroll et al. |
| 5,419,256 | A | 5/1995 | Pollich |
| 5,421,814 | A | 6/1995 | Geary |
| 5,423,791 | A | 6/1995 | Bartlett |
| 5,425,465 | A | 6/1995 | Healy |
| 5,429,256 | A | 7/1995 | Kestenbaum |
| 5,433,330 | A | 7/1995 | Yatsko et al. |
| 5,433,703 | A | 7/1995 | Utterberg et al. |
| 5,435,282 | A | 7/1995 | Haber et al. |
| 5,437,648 | A | 8/1995 | Graves et al. |
| 5,441,487 | A | 8/1995 | Vedder |
| 5,454,409 | A | 10/1995 | Mc Affer et al. |
| 5,454,805 | A | 10/1995 | Brony |
| 5,466,219 | A | 11/1995 | Lynn et al. |
| 5,470,319 | A | 11/1995 | Mayer |
| 5,470,327 | A | 11/1995 | Helgren et al. |
| 5,474,541 | A | 12/1995 | Ritsky et al. |
| 5,474,544 | A | 12/1995 | Lynn |
| 5,487,737 | A | 1/1996 | Meyer |
| 5,494,170 | A | 2/1996 | Burns |
| 5,501,676 | A | 3/1996 | Niedospial et al. |
| 5,514,116 | A | 5/1996 | Vaillancourt et al. |
| 5,514,117 | A | 5/1996 | Lynn |
| 5,520,641 | A | 5/1996 | Behnke et al. |
| 5,520,642 | A | 5/1996 | Bigagli et al. |
| 5,520,661 | A | 5/1996 | Lal et al. |
| 5,520,665 | A | 5/1996 | Fleetwood |
| 5,520,666 | A | 5/1996 | Choudhury et al. |
| 5,533,983 | A | 7/1996 | Haining |
| 5,533,994 | A | 7/1996 | Meyer |
| 5,549,651 | A | 8/1996 | Lynn |
| 5,566,729 | A | 10/1996 | Grabenkort et al. |
| 5,573,516 | A | 11/1996 | Tyner |
| 5,573,520 | A | 11/1996 | Schwartz et al. |
| 5,573,525 | A | 11/1996 | Watson et al. |
| 5,573,526 | A | 11/1996 | Hess |
| 5,576,392 | A | 11/1996 | Yamamoto et al. |
| 5,598,939 | A | 2/1997 | Watson et al. |
| 5,613,291 | A | 3/1997 | Solomon et al. |
| 5,616,129 | A | 4/1997 | Mayer |
| 5,616,130 | A | 4/1997 | Mayer |
| 5,620,434 | A | 4/1997 | Brony |
| 5,641,010 | A | 6/1997 | Maier |
| 5,662,230 | A | 9/1997 | Finnneran |
| 5,685,845 | A | 11/1997 | Grimard |
| 5,697,915 | A | 12/1997 | Lynn |

| | | | | |
|---|---|---|---|---|
| 5,702,019 | A | 12/1997 | Grimard | |
| 5,709,666 | A | 1/1998 | Reynolds | |
| 5,718,348 | A | 2/1998 | Manera | |
| 5,776,124 | A | 7/1998 | Wald | |
| 5,776,125 | A | 7/1998 | Dudar et al. | |
| 5,785,701 | A | 7/1998 | Sams et al. | |
| 5,803,284 | A | 9/1998 | Grimard | |
| 5,819,964 | A | 10/1998 | Grimard | |
| 5,833,089 | A | 11/1998 | Manni et al. | |
| 5,855,575 | A | 1/1999 | Solomon et al. | |
| 5,863,655 | A | 1/1999 | Mock | |
| 5,873,872 | A | 2/1999 | Thibault et al. | |
| 5,879,345 | A | 3/1999 | Aneas | |
| 5,891,129 | A | 4/1999 | Daubert et al. | |
| 5,925,029 | A | 7/1999 | Jansen et al. | |
| 5,931,828 | A | 8/1999 | Durkee | |
| 5,954,104 | A | 9/1999 | Daubert et al. | |
| 5,957,898 | A | 9/1999 | Jepson et al. | |
| 6,003,566 | A | 12/1999 | Thibault et al. | |
| 6,039,093 | A | 3/2000 | Mrotzek et al. | |
| 6,050,435 | A | 4/2000 | Bush et al. | |
| 6,056,135 | A | 5/2000 | Widman | |
| 6,070,623 | A | 6/2000 | Aneas | |
| 6,071,270 | A | 6/2000 | Fowles et al. | |
| 6,139,534 | A | 10/2000 | Niedospial, Jr. et al. | |
| 6,189,580 | B1 * | 2/2001 | Thibault et al. | 141/25 |
| 6,209,738 | B1 * | 4/2001 | Jansen et al. | 141/329 |
| 6,378,714 | B1 * | 4/2002 | Jansen et al. | 141/329 |
| 6,382,442 | B1 * | 5/2002 | Thibault et al. | 215/247 |

FOREIGN PATENT DOCUMENTS

| | | |
|---|---|---|
| EP | 0 065 469 A2 | 5/1992 |
| EP | 0 769 456 A2 | 10/1996 |
| EP | 0 747 293 A1 | 12/1996 |
| WO | WO 84/04673 | 12/1984 |
| WO | WO 88/01881 | 3/1988 |
| WO | WO 92/11056 | 7/1992 |
| WO | WO 94/03373 | 2/1994 |
| WO | WO 95/00117 | 1/1995 |
| WO | WO 95/03841 | 2/1995 |
| WO | WO 95/14176 | 5/1995 |
| WO | WO 95/31242 | 11/1995 |
| WO | WO 95/33505 | 12/1995 |
| WO | WO 95/35125 | 12/1995 |
| WO | WO 96/13301 | 5/1996 |
| WO | WO 97/00702 | 1/1997 |
| WO | WO 97/10156 | 3/1997 |
| WO | WO 97/39720 | 10/1997 |
| WO | WO 98/13006 | 4/1998 |
| WO | WO 98/32411 | 7/1998 |
| WO | WO 98/37853 | 9/1998 |
| WO | WO 98/37854 | 9/1998 |

OTHER PUBLICATIONS

UK Patent Application No. 2 121 016 A, Jun. 1, 1983.
French Patent No. 950.625, Jul. 28, 1947.
French Patent No. 1.071.487, Feb. 26, 1953.
French Patent No. 1.328.635, Jul. 4, 1962.
French Patent No. 1.487.413, May 20, 1966.
French Patent No. 2.395.198, Jan. 19, 1979.
French Patent No. 2.738.550, Sep. 9, 1995.

* cited by examiner

RESEALABLE MEDICAL TRANSFER SET

RELATED APPLICATIONS

This application is a continuation-in-part of application Ser. No. 09/168,502, filed Oct. 8, 1998 now U.S. Pat. No. 6,382,442, which claimed priority to provisional Application Ser. No. 60/082,372, filed Apr. 20, 1998 and is a continuation-in-part art of application Ser. No. 09/454,453, filed Dec. 6, 1999 now U.S. Pat. No. 6,189,580, which was a continuation of application Ser. No. 09/031,302, filed Feb. 26, 1998, now U.S. Pat. No. 6,003,566.

FIELD OF THE INVENTION

This invention relates to an improved universal resealable transfer set for transferring fluid, including drugs, vaccines, medicaments, solutions and the like, between a first container, such as a conventional vial having a pierceable elastomeric closure or stopper, and a second container, such as a conventional syringe having a luer connector. The transfer set assembly includes a fluid transfer member having a resealable valve member which permits repeated use of the transfer set for transferring fluid between the first and second containers.

BACKGROUND OF THE INVENTION

It is conventional to store drugs, vaccines, solutions and medicaments in a sealed vial or other container for later use. Such materials may be in a dry or powdered form to increase the shelf life and reduce inventory space. Such dry or powdered materials may be stored in a conventional sealed vial having an elastomeric stopper and reconstituted in liquid form for administration to a patient by adding a diluent or solvent. Alternatively, the material may be stored in liquid or even a gaseous form. A conventional vial for storing drugs, vaccines, medicaments and the like, generally includes an open end, a radial rim portion surrounding the open end and a reduced diameter neck portion adjacent the rim portion. The vial is conventionally sealed with an elastomeric stopper which generally includes a generally tubular portion inserted into the neck of the vial and a planar rim portion which overlies the vial rim. The stopper is normally secured to the vial with a thin malleable metal cap, such as aluminum. Because aluminum is malleable, the collar accommodates the buildup of tolerances of the dimensions of the stopper and vial rim. The dimensions and tolerances of standard vials and stoppers are set by the International Standards Organization (ISO).

Recently, various vial transfer sets have been proposed for transferring fluid between a vial and a conventional syringe wherein the transfer set is mounted on the vial for later use. The proposed transfer sets, however, do not permit multiple uses of the transfer set, limiting their use to one application. The transfer set may include a piercing member, such as a needle cannula, generally telescopically mounted in a tubular fluid transfer member mounted on the open end of the vial. The transfer set may be enclosed by cup-shaped closure having a radial flange portion secured to the vial by malleable metal or plastic collar. Examples of such improved transfer sets include U.S. Pat. No. 6,003,566 assigned to the assignee of this application and pending application Ser. No. 09/168,502, filed Oct. 8, 1998 assigned to the assignee of this application, the disclosures of which are hereby incorporated by reference in their entirety.

As set forth above, however, the prior proposed vial transfer sets are not resealable and are therefore limited to a single use. U.S. Pat. Nos. 5,474,544, 5,549,651 and 5,697,915 disclose luer receiving medical valves having a slit silicone membrane and which eliminates the requirement for a needle cannula on the syringe, sometimes referred to as a "luer slip connector." The medical valve disclosed in these patents are not, however, readily adaptable to a transfer set because the longitudinally slit cylindrical polymeric membrane must first be moved within the valve to a larger diameter chamber and then compressed by the luer slip connector of the syringe to expand and open the slit for transfer of fluid. Further, the luer receiving medical valve disclosed in these patents do not provide for piercing of a closure, such as the pierceable stopper of a conventional vial.

The need therefore remains for a universal transfer set suitable for use with a conventional sealed vial for transfer of fluids between a vial and a second container, such as a conventional syringe, whereby the transfer set is resealable for multiple applications. The resealable transfer set of this invention fulfills this need in a simple, reliable design, which is easily used by a healthcare worker. The resealable transfer set of this invention can be utilized to transfer fluids between a conventional vial having a conventional elastomeric stopper and a conventional syringe without a needle cannula. However, the improved resealable transfer set of this invention is universal in that it can be used to transfer any fluid between a first container having a pierceable closure and a second container.

SUMMARY OF THE INVENTION

As set forth above, the resealable transfer set of this invention may be utilized for transferring fluid between a first container having a pierceable closure, such as a conventional vial having an elastomeric stopper, and a second container, such as a conventional syringe without requiring a needle cannula. The transfer set includes a unique generally tubular elastomeric fluid transfer valve member, preferably molded of sterilizeable silicone, including an open end portion coaxially aligned with the container opening and a generally closed distal end portion having a longitudinal slit therethrough. A piercing member is telescopically received in the fluid transfer valve member through the open end including a piercing end adjacent the pierceable closure of the first container and a distal end adjacent the generally closed end of the fluid transfer valve member opposite and most preferably adjacent the longitudinal slit. For ease of description, the portions of the transfer set adjacent the pierceable closure or elastomeric stopper are referred to as "proximate" and the portions remote from the pierceable closure are referred to as "distal."

Fluid may then be transferred between the first container and the second container by driving a tubular portion of the second container through the slit in the distal end of the elastomeric fluid transfer valve member against the piercing member, which drives the piercing end through the pierceable closure. Although the resealable transfer set of this invention may be utilized for transferring fluids between various containers, and is therefore not limited to the types of containers utilized, one important advantage of the resealable transfer set of this invention is that it may be utilized to transfer fluids between a conventional vial sealed with a conventional elastomeric stopper and a conventional syringe having a luer slip connector. Thus, the resealable fluid transfer set will now be described for use with a conventional vial and syringe for ease of description.

The preferred embodiment of the tubular connector member includes a male luer connector at its distal end which receives the luer connector of a conventional syringe having a female luer connector. Threading of the luer connector of the syringe on the luer connector of the tubular luer connector member drives the tubular end of the syringe through the longitudinal slit against the distal end of the piercing member, driving the piercing end through the elastomeric stopper and establishing fluid communication between the syringe and the vial. In the preferred embodiment, the piercing member includes a generally longitudinal channel, establishing fluid communication between the vial and the syringe through the generally tubular elastomeric fluid transfer valve member. In the most preferred embodiment, the free distal end of the elastomeric fluid transfer valve member includes a radial annular lip portion which is received over the distal end of the generally tubular luer connector member, supporting and retaining the tubular elastomeric fluid transfer member. Further, the generally tubular elastomeric fluid transfer valve member includes an outwardly tapered or conical enlarged tubular portion adjacent the generally closed distal end portion which is generally hourglass-shaped and the distal end of the piercing member includes an enlarged conical head portion, such that the piercing member is releasably retained in the elastomeric fluid transfer valve member during assembly and prior to use. The preferred embodiment of the generally tubular luer connector member then includes a lateral opening or openings which permits lateral expansion of the conical portion of the fluid transfer valve member and release of the piercing member.

Upon removal of the tubular portion of the syringe or second container from the longitudinal slit in the generally closed distal end portion of the fluid transfer valve member, the slit closes effectively resealing the transfer set for later use. All that is required for later reuse is to swab the surface of the exposed closed distal end with a suitable sterilizing fluid. Thus, the resealable transfer set of this invention is suitable for multiple uses, permitting storage of a greater quantity of medicament in the vial.

The preferred embodiment of the resealable transfer set of this invention further includes a cup-shaped closure surrounding the luer connector member including an open end having a radial flange portion mounted on the vial by a collar, such as a conventional malleable aluminum collar or an improved plastic collar as disclosed in the above-referenced U.S. Pat. No. 6,003,566, the disclosure of which is incorporated herein by reference. The cup-shaped closure surrounds the generally tubular luer connector member and the elastomeric fluid transfer valve member and includes a closed distal end. In a most preferred embodiment, the collar includes a first proximate tubular portion which is received around the radial flange portion of the closure, the planar rim portion of the elastomeric stopper and the rim of the vial including a free end deformed or otherwise received in the neck portion of the vial, and a second distal tubular portion which surrounds the proximate tubular portion of the closure or cap and the closure includes a frangible portion located within the second distal tubular portion of the collar. The closure is then removed by breaking the frangible connection, exposing the generally closed distal end portion of the fluid transfer valve member for receipt of the tubular portion of a syringe or other container.

As described more fully in the above-referenced co-pending patent application Ser. No. 09/168,502, the plastic collar or closure may be formed of a polymer alloy or melt blend which includes a relatively tough soft malleable co-polymer and a relatively rigid polymer, such that the free end of the proximate tubular portion may be deformed or crimped into the reduced diameter neck portion of the vial. The preferred relatively rigid polymer is a polyamid or a polycarbonate and the preferred relatively soft co-polymer may be selected from polyesters or polyolefins. The resultant polymer alloy or composite preferably has an elongation that yield between 5% and 10% and an elongation at break greater than 100% with a flectural modulus of greater than 1900 MPa. Suitable polymers for the plastic collar of the transfer set of this invention include EASTAROR® polymers, which are melt blend and alloy polymers and EASTAR® thermoplastic polymers, which are neat polymers sold by Eastman Chemical Company of Kingsport, Tenn. and Eastman Chemical AG of Zug, Switzerland under the tradenames "DA003," "DN003" and "DN004." Other polymers having similar properties will also be suitable for this application. Alternatively, the collar may be formed of a malleable metal, such as aluminum, as disclosed in the above-referenced U.S. Pat. No. 6,003,566.

The transfer set of this invention may be assembled prior to application to a vial by telescopically receiving the piercing member in the generally tubular elastomeric fluid transfer valve member, which is releasably retained in the fluid transfer valve member as described above. The fluid transfer valve member and piercing member may then be inserted into the generally tubular luer connector member, which is retained in place by the radial annular lip portion described above, and the assembly received in the cup-shaped closure and collar which, in the disclosed embodiment, is retained to the closure by lip received in a groove in the collar.

The transfer set assembly of this invention is resealable and suitable for multiple uses as described above and the design is relatively simple and may be manufactured at relatively low cost. The transfer set assembly is also reliable and simple to use for transferring fluids between a vial and a syringe by healthcare workers. Other advantages and meritorious features of the present invention will be more fully understood from the following description of the preferred embodiments, the appended claims and the drawings, a brief description of which follows.

DETAILED DESCRIPTION OF THE PREFERRED EMBODIMENTS

Figure 1:
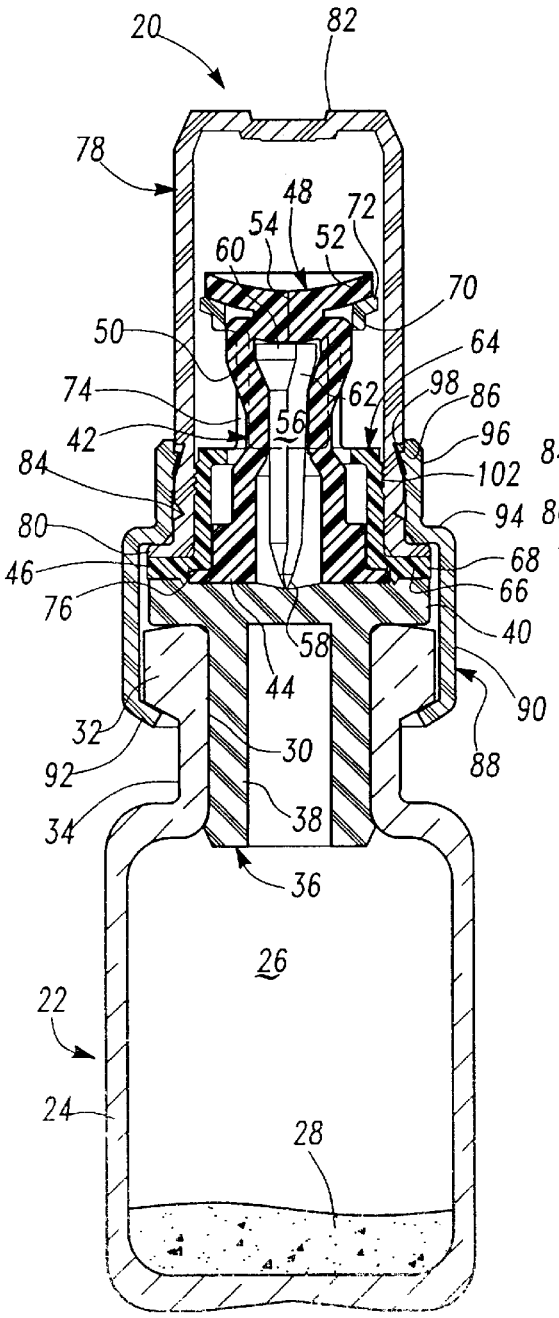
FIG. 1 is a side cross-sectional view of a preferred embodiment of the resealable transfer set of this invention assembled on a conventional vial.

As described above, the preferred embodiments of the resealable transfer set assembly 20 of this invention may be utilized with a conventional vial 22, typically formed of glass, but may also be formed of plastic. A typical medicament vial 22 includes a body portion 24 defining an enclosure 26 which may receive dry or powdered medicament or drug for later reconstitution in liquid form by adding a diluent or solvent. The vial further includes an open end 30, a rim portion 32 surrounding the open end of the vial and a reduced diameter neck portion 34 adjacent the rim portion. Medicament vials are typically sealed with an elastomeric stopper 36 which may be formed of natural or synthetic rubber. A typical elastomeric stopper includes a tubular portion 38 having a diameter slightly greater than the internal diameter of the opening 30 to provide a good seal, and a planar rim portion 40 which overlies the rim portion 32 of the vial. As described above, however, the transfer set 20 of this invention may be utilized to sealingly transfer fluids between various containers and the transfer set of this invention is not limited to a particular container, such as the disclosed conventional vial.

The improved resealable transfer set of this invention includes a unique generally tubular elastomeric fluid transfer valve member 42 preferably formed of a resilient sterilizeable plastic, such as silicone. The transfer valve member includes a proximate open end portion 44 which is mounted on the planar portion 40 of the elastomeric stopper 36 in coaxial alignment with the opening 30 of the vial 22. The proximate open end portion 44 includes a radial annular rim 46 which nests into the generally tubular luer connector member 64 described below. The fluid transfer valve member 42 further includes a generally closed distal end portion 48 having a longitudinal slit 54 for providing communication through the end portion 48 as described below. As shown in FIG. 1, the preferred embodiment of the fluid transfer valve member 42 is hourglass-shaped, including an outwardly tapered or conical enlarged tubular portion 50 which releasably retains the piercing member 56 as described below. In the preferred embodiment, the generally closed distal end portion 48 of the fluid transfer valve member 42 further includes a generally radial annular lip portion 52 which overlies the distal end of the generally tubular luer connector member 64 described below. It should also be appreciated that the valve member 42 be in the form of a thin plastic film or a multi-layer membrane sealed to the luer connecting member. Also, the longitudinal slit 54 may be in the form of a pre-pierced portion to accommodate a needle or simply pierceable closed membrane or the like in the event the piercing member includes a double ended cannula.

A piercing member 56 is telescopically received through the proximate open end portion 44 of the fluid transfer valve member 42. The piercing member 56 includes a relatively sharp piercing end 58, and an enlarged conical distal head 60 which is releasably retained in the outwardly tapered conical portion 50 of the resilient fluid transfer valve member 42 as discussed further below. The disclosed embodiment of the piercing member 56 further includes a longitudinal V-shaped channel 62 providing communication between the interior 26 of the vial and a second container as described below. As will be understood, however, the channel 62 may be of various shapes and configurations including, for example, a discontinuous channel or a longitudinal passage.

The preferred embodiment of the improved resealable transfer set assembly 20 of this invention further includes a generally tubular luer connector member 64 which surrounds the fluid transfer valve member 42 as shown. The luer connector member includes an open proximate end portion 66, which is generally coaxially aligned with the opening 30 in the vial, having a radial rim portion 68 overlying the planar rim portion 40 of the elastomeric stopper. The luer connector member further includes an open distal end 70 having male luer threads 72 which interconnects the vial to a second container, such as a conventional syringe, as described below. The preferred embodiment of the luer connector member 64 further includes a lateral or transverse opening or openings 74 which permit the outwardly tapered conical portion 50 of the fluid transfer valve member to expand and release the enlarged conical head 60 of the piercing member 56 as described below. In the preferred embodiment of the luer connector member 64, the radial rim portion 66 includes an annular barb 76 which bites into the radial rim portion 40 of the elastomeric stopper, preventing leakage.

The transfer valve member 42 and luer connector member 64 are enclosed and hermetically sealed in the disclosed embodiment by a cup-shaped closure or cap 78. The closure or cap includes a radial rim portion 80 which overlies the radial rim portion 68 of the luer connector member 64 and a closed distal end 82. The disclosed embodiment of the closure 78 further includes a weakened frangible portion 84 in the form of a V-shaped groove and a second groove 86 which receives the radial rib 98 of the collar 88 as described below.

Figure 3:
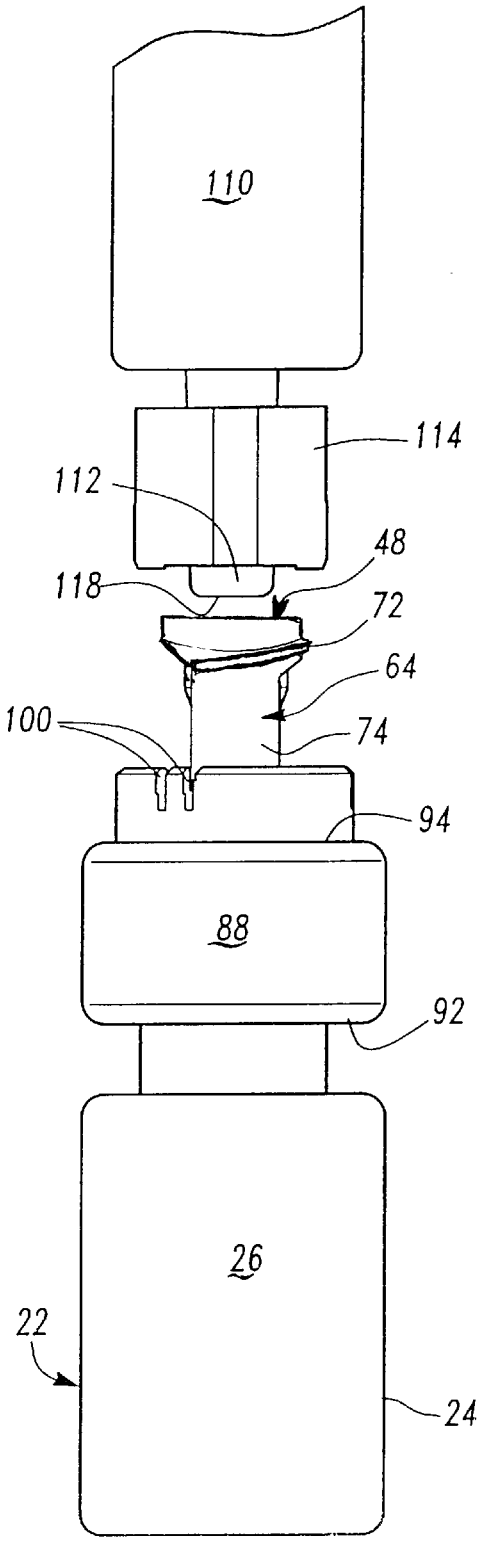
FIG. 3 is a side view of the transfer set assembly following removal of the closure ready for receiving the tubular portion of a syringe.

The transfer set assembly is secured to the rim portion 32 of the vial in the disclosed embodiment by a plastic collar 88 which may be formed of a polymer alloy or melt blend as described above. The collar 88 includes a proximate tubular portion 90 which surrounds the radial rim portions 68 and 80 of the tubular luer connector member 64 and the cup-shaped closure 78, respectively, the planar rim 40 of the stopper and the neck 32 of the vial. The free end 92 of the proximate tubular portion 90 is deformed or crimped into the neck portion 34 of the vial. The collar 88 further includes a radial portion 94 overlying the radial rim portion 80 of the closure and a distal tubular portion 96 which overlies the proximate portion of the closure including the V-shaped groove 84, protecting the frangible portion prior to use. The free end of the distal tubular portion 96 further includes a radial rib 98 which snaps into the second annular groove 86, retaining the collar 88 on the cap following assembly of the resealable transfer set assembly, prior to assembly on the vial. The distal tubular portion 96 may include a plurality of axial grooves 100, as shown in FIG. 3, such that the internal diameter of the distal tubular portion 96 of the collar is approximately equal to the external diameter of the cap and the rib then snaps into the second annular groove 86 during assembly. The internal surface of the closure 78 may also include a plurality of ribs 102 which may include a sealant such as silicone grease to further ensure sealing between the luer connector member and the cap.

Figure 2:
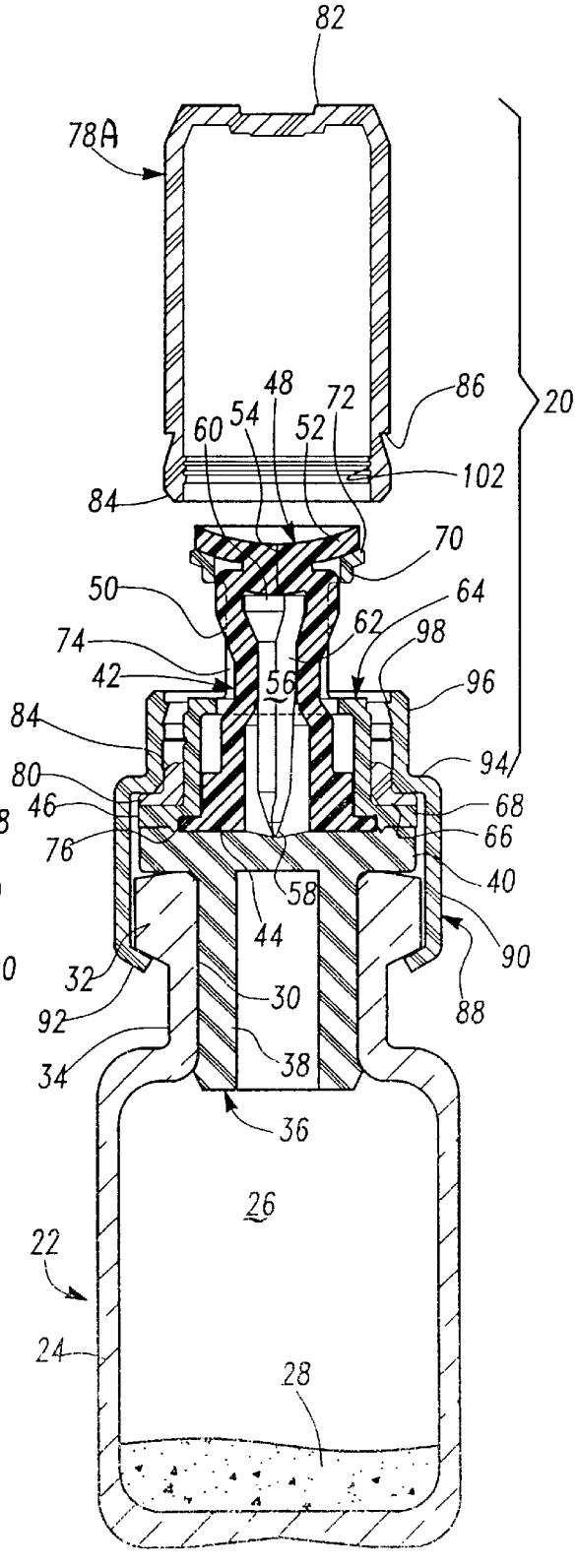
FIG. 2 is a side cross-sectional view similar to FIG. 1 following removal of the cup-shaped closure.
Figure 4:
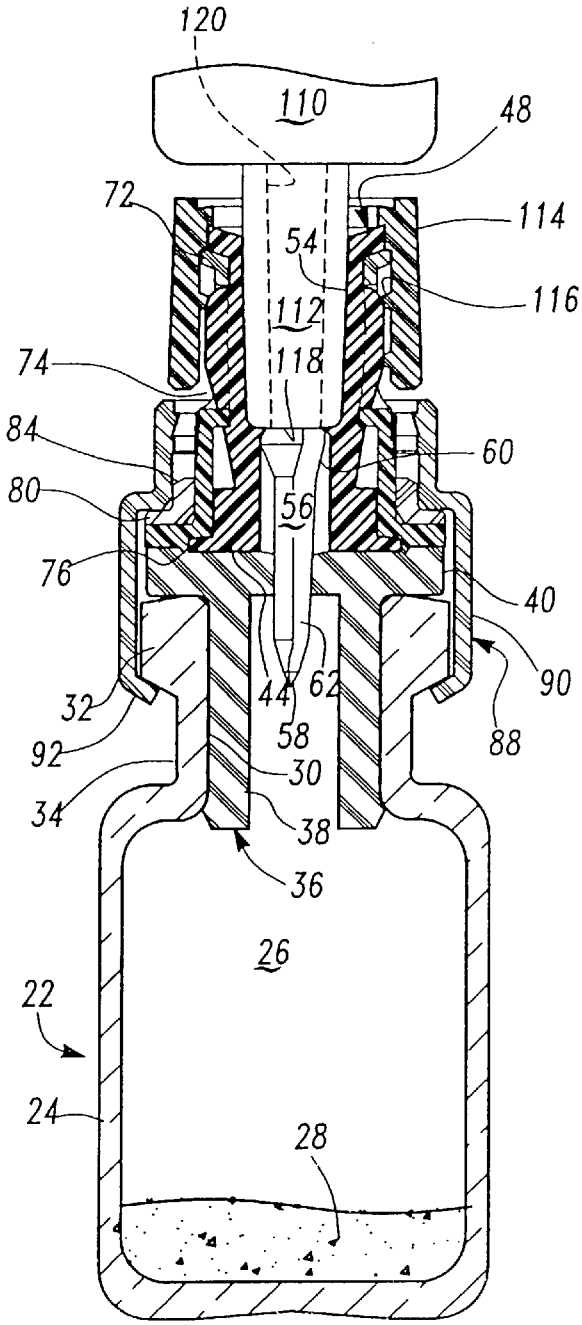
FIG. 4 is a side partially cross-sectioned view of the transfer set and vial assembly shown in FIGS. 1 and 2 following threaded securement of the syringe on the transfer set.

Having described the components of the improved resealable transfer set assembly 20 of this invention, the operation and use may now be described. The first step is to remove the distal portion 78A of the cap as shown in FIG. 2. This is accomplished by grasping the cap and twisting or turning, thereby breaking the weakened frangible portion 84. The transfer set is then ready for use as shown in FIG. 3. As described above, the transfer set assembly of this invention may be utilized with a conventional syringe 110 having a tubular projecting tip 112 and a female luer connector 114. The female luer connector 114 includes female threads 116 which thread onto the male luer threads 72 as shown in FIG. 4. Threading of the female luer connector 114 onto the luer connector 72 on the open distal end 70 of the luer connector member 64 fully drives the tubular tip or end 112 of the syringe through the slit 54 of the elastomeric fluid transfer valve member 42 as shown in FIG. 4. As will be understood, the longitudinal slit 54 is spaced from the opposed sides of the generally closed distal end portion 48 of the transfer valve member to prevent splitting of the transfer valve member. But the length of the slit will depend upon the diameter of the tubular tip 112. The free end 118 of the tubular tip 112 is then driven against the distal end 60 of the piercing member 56, driving the piercing end 58 of the piercing member through the planar rim portion 40 of the elastomeric stopper 36. Fluid communication is thus established between the interior 26 of the vial 22 through the channel 62 of the piercing member into the port 120 of the tubular tip portion 112 of the syringe. Alternatively, a needle cannula may be utilized in place of the piercing member upon opening of the valve.

Figure 5:
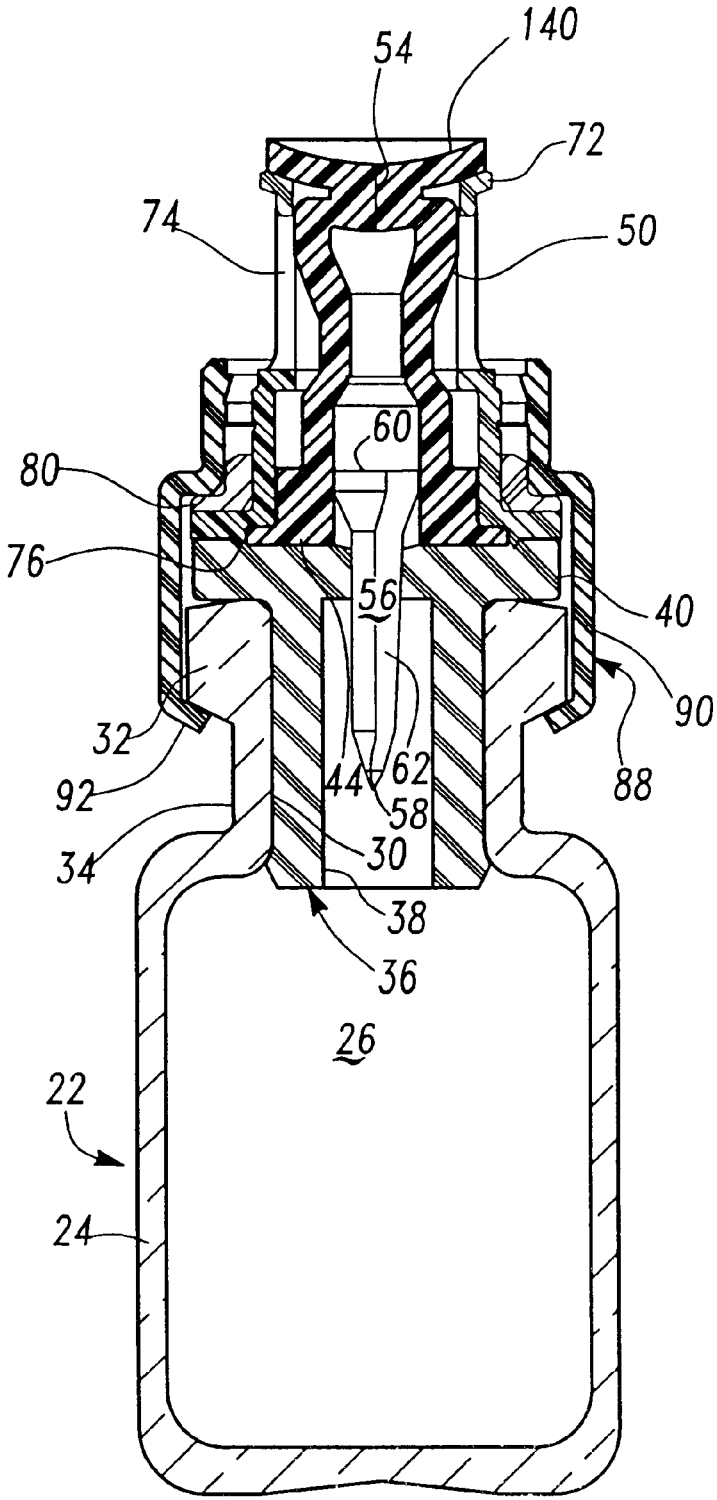
FIG. 5 is a side cross-sectional view similar to FIG. 4 following removal of the syringe.

Upon withdrawal of the tip 112 of the syringe 110 or other conduit or container as shown in FIG. 5, the longitudinal slit 54 recloses or seals; however, the medication in the vial remains ready for use. It is recommended, however, that the end surface 140 be swabbed with a suitable sterilization solution prior to reuse. An example of the use of the resealable transfer set assembly of this invention is as follows. As set forth above, the vial 22 may contain a dry or powdered medicament or drug. The drug may be reconstituted by adding a diluent or solvent from a syringe by removing the portion 78A of the cap as shown in FIG. 2. A solvent or diluent is then added to the dry or powdered medicament or drug 28 by threading the luer connector 114 onto the luer connector 72 of the luer connector member 64 as shown in FIG. 4 and the solvent or diluent is added to the dry or powdered medicament by driving the plunger (not shown) of the syringe. The assembly is then turned upside down and shakened to reconstitute the drug. A portion of the liquid reconstituted drug may then be removed by withdrawing the plunger (not shown) of the syringe. Further reconstituted drug or medicament may be removed at a later time for further application to a patient. The resealable transfer set of this invention therefore permits removal of several applications of the reconstituted drug or medicament, thereby taking advantage of the shelf life of dry or powdered drugs or medicaments while permitting several applications of the reconstituted drug or medicament.

The transfer set of this invention therefore fulfills the need for a resealable transfer set for multiple applications of a drug or medicament in a simple low cost design. Further, the resealable transfer set of this invention is reliable and simple to use by a healthcare worker. The transfer set assembly also eliminates the need for using a needle cannula for reconstituting a drug. As will be understood by those skilled in the art, various modifications may be made to the improved resealable transfer set of this invention within the purview of the appended claims. For example, the plastic collar 88 may be replaced with a malleable metal collar, such as aluminum.

What is claimed is:

1. A resealable transfer set for transferring fluid between a first container having an opening sealed with a pierceable closure and a second container, said transfer set comprising: a generally tubular elastomeric fluid transfer valve member mounted on said first container having an open end portion generally coaxially aligned with said opening of said first container, a generally closed portion spaced from said open end portion having a longitudinal slit therethrough, and an outwardly tapered tubular portion adjacent said generally closed portion, a piercing member telescopically received within said fluid transfer valve member between said open end portion and said generally closed portion generally coaxially aligned with said first container opening, said piercing member having a first relatively sharp piercing end portion opposite said pierceable closure and a second distal end portion opposite said generally closed portion of said transfer valve member, said distal end being enlarged to be closely received in said outwardly tapered tubular portion of said fluid transfer valve member, said piercing member being releasably retained in said fluid transfer valve member, and a generally tubular luer connector member surrounding said fluid transfer valve member having a lateral opening adjacent said outwardly tapered tubular portion of said fluid transfer valve member, permitting said outwardly tapered tubular portion to expand laterally and release said distal end portion of said piercing member, whereby a generally tubular portion of said second container may be driven through said slit in said generally closed portion of said fluid transfer valve member against said second distal end portion of said piercing member, driving said first piercing end portion of said piercing member through said pierceable closure and establishing fluid communication between said first and second containers.

2. The resealable transfer set defined in claim 1, wherein said piercing member includes a generally longitudinally extending external channel establishing fluid communication between said first and second containers through said fluid transfer valve member.

3. The resealable transfer set defined in claim 1, wherein said generally tubular luer connector member includes a first proximate open end portion mounted on said first container and a second open distal end portion adjacent said generally closed portion of said fluid transfer valve member having a luer threaded portion.

4. The resealable transfer set defined in claim 3, wherein said generally closed portion of said fluid transfer valve member includes a generally radial annular lip portion overlying a distal end portion of said generally tubular luer connector member retaining and supporting a distal end of said fluid transfer valve member on said first container.

5. The resealable transfer set defined in claim 3, wherein said transfer set includes a cup-shaped closure surrounding said generally tubular luer connector member having an open end mounted on said first container and a closed distal end.

6. The resealable transfer set defined in claim 1, wherein said transfer set includes a cup-shaped closure surrounding said fluid transfer valve member having an open end mounted on said first container and a closed distal end.

7. The resealable transfer set defined in claim 6, wherein said transfer set includes a collar having a first proximate tubular portion surrounding said open end portion of said fluid transfer valve member mounting said fluid transfer set on said first container and a second distal tubular portion surrounding a portion of said cup-shaped closure adjacent said open end of said closure.

8. The resealable transfer set defined in claim 7, wherein said closure includes a frangible portion surrounded by said second distal tubular portion of said collar.

9. A resealable transfer set for transferring fluid between a vial having an open end and an elastomeric closure sealing said open end and a second container, said transfer set comprising: a generally tubular elastomeric fluid transfer valve member mounted on said open end of said vial having an open end portion generally coaxially aligned with said open end of said vial and a generally closed distal end portion spaced from said open end portion having a longitudinal slit therethrough, a piercing member telescopically received in said fluid transfer valve member generally coaxially aligned with said elastomeric closure having a first piercing end portion opposite said elastomeric closure and a second distal end portion adjacent said generally closed distal end portion of said fluid transfer valve member, and a generally tubular luer connector member generally surrounding said fluid transfer valve member having a first open proximate tubular portion mounted on said vial open end and a second distal end portion adjacent said generally closed portion of said fluid transfer valve member having a luer threaded portion, whereby a generally tubular portion of said second container having a luer connector may be threaded on said luer threaded portion of said luer connector member, driving said generally tubular portion of said second container through said slit in said generally closed portion of said fluid transfer valve member against said second distal end portion of said piercing member, driving said piercing end of said piercing member through said elastomeric closure in said vial open end and establishing fluid communication between said vial and said second container.

10. The resealable transfer set defined in claim 9, wherein said generally tubular elastomeric fluid transfer valve member includes an outwardly tapered enlarged tubular portion adjacent said generally closed portion of said fluid transfer valve member and said piercing member second distal end portion is enlarged to be closely received in said enlarged tubular portion of said fluid transfer valve member, thereby releasably retaining said piercing member in said fluid transfer valve member.

11. The resealable transfer set defined in claim 10, wherein said generally tubular luer connector member includes a lateral opening adjacent said outwardly tapered enlarged tubular portion of said fluid transfer valve member permitting said enlarged tubular portion of said fluid transfer valve member to expand laterally as said generally tubular portion of said second container is driven through said slit and release said piercing member.

12. The resealable transfer set defined in claim 9, wherein said piercing member includes a generally longitudinally extending external channel establishing fluid communication between said vial and said second container through said fluid transfer valve member.

13. The resealable transfer set defined in claim 9, wherein said generally closed portion of said fluid transfer valve member includes a generally radial annular lip portion overlying said distal end portion of said generally tubular luer connector member retaining and supporting a distal end of said fluid transfer valve member in said luer connector member.

14. The resealable transfer set defined in claim 9, wherein said transfer set includes a cup-shaped closure surrounding said generally tubular luer connector member having an open end mounted on said vial open end and a closed distal end.

15. The resealable transfer set defined in claim 14, wherein said transfer set includes a collar having a first proximate tubular portion surrounding said open end portion of said fluid transfer valve member having a radial portion received in a reduced diameter neck portion of said vial adjacent said open end and a second distal tubular portion surrounding a portion of said cup-shaped closure adjacent said open end of said closure and said closure having a frangible portion surrounded by said second distal tubular portion of said collar.

16. A resealable transfer set for transferring fluid between a vial having an open end sealed with an elastomeric stopper and a second container having a tubular portion and a luer connector surrounding said tubular portion, said transfer set comprising: a generally tubular elastomeric fluid transfer valve member having an open end portion generally coaxially aligned with said open end of said vial mounted on said vial open end and a generally closed distal end portion having a longitudinal slit therethrough, a piercing member telescopically received within said fluid transfer valve member generally coaxially aligned with said elastomeric stopper having a piercing proximate end portion opposite said elastomeric stopper and a second distal end portion adjacent said generally closed portion of said fluid transfer valve member, a generally tubular luer connector member surrounding said fluid transfer valve member including an open proximate end having a radial portion overlying said elastomeric stopper and an open distal end portion adjacent said generally closed portion of said fluid transfer valve member, and a collar including a radial portion overlying said radial portion of said luer connector member, a tubular portion surrounding said elastomeric stopper and a neck portion of said vial adjacent said open end and a free end portion received in a reduced diameter portion of said vial adjacent said rim portion securing said transfer set on said vial, whereby threading of said luer connector of said second container on said luer connector of said luer connector member of said transfer set drives said tubular end portion of said container through said longitudinal slit of said generally closed portion of said fluid transfer valve member against said distal end portion of said piercing member, driving said piercing end portion of said piercing member through said elastomeric stopper and establishing fluid communication between said vial and said second container.

17. The resealable transfer set defined in claim 16, wherein said generally tubular elastomeric fluid transfer valve member includes an outwardly tapered enlarged tubular portion adjacent said generally closed portion and said piercing member distal end portion is enlarged to be closely received in said outwardly tapered enlarged tubular portion of said fluid transfer valve member, releasably retaining said piercing member in said fluid transfer valve member.

18. The resealable transfer set defined in claim 16, wherein said piercing member includes a generally longitudinal external channel establishing fluid communication between said vial and said container through said fluid transfer valve member.

19. The resealable transfer set defined in claim 16, wherein said transfer set includes a cup-shaped closure surrounding said luer connector member including an open end portion having a radial portion received beneath said radial portion of said collar securing said closure on said vial and a closed distal end portion.

20. The resealable transfer set defined in claim 19, wherein said closure includes a frangible portion adjacent said radial portion and said collar includes a second tubular portion adjacent said radial portion overlying said frangible portion of said closure.

21. The resealable transfer set defined in claim 16, wherein said generally closed portion of said fluid transfer member includes a generally radial annular lip portion overlying a distal end portion of said generally tubular luer connector member retaining and supporting a distal end of said fluid transfer valve member in said luer connector member.

22. A resealable transfer set for transferring fluid between a first container having an opening sealed with a pierceable closure and a second container, said transfer set comprising:

a generally tubular elastomeric fluid transfer valve member mounted on said first container having an open end portion generally coaxially aligned with said opening of said first container and a generally closed portion spaced from said open end portion having a longitudinal slit therethrough, a piercing member telescopically received within said fluid transfer valve member between said open end portion and said generally closed portion generally coaxially aligned with said first container opening, said piercing member having a first relatively sharp piercing end portion opposite said pierceable closure and a second distal end portion opposite said generally closed portion of said transfer valve member, a cup-shaped closure surrounding said fluid transfer valve member having an open end mounted on said first container and a closed distal end, and a collar having a first proximate tubular portion surrounding said open end portion of said fluid transfer valve member mounting said fluid transfer set on said first container and a second distal tubular portion surrounding a portion of said cup-shaped closure adjacent said open end of said closure, wherein said closure includes a frangible portion surrounded by said second distal tubular portion of said collar, whereby a generally tubular portion of said second container may be driven through said slit in said generally closed portion of said fluid transfer valve member against said second distal end portion of said piercing member, driving said first piercing end portion of said piercing member through said pierceable closure and establishing fluid communication between said first and second containers.

23. The resealable transfer set as defined in claim 22, wherein said generally tubular elastomeric fluid transfer valve member includes an outwardly tapered tubular portion adjacent said generally closed portion and said piercing member second distal end portion is enlarged to be closely received in said outwardly tapered tubular portion of said fluid transfer valve member, said piercing member being releasably retained in said fluid transfer valve member.

24. The resealable transfer set defined in claim 23, wherein said transfer set includes a generally tubular luer connector member surrounding said fluid transfer valve member having a lateral opening adjacent said outwardly tapered tubular portion of said elastomeric fluid transfer valve member, permitting said outwardly tapered tubular portion to expand laterally and release said distal end portion of said piercing member.

25. The resealable transfer set defined in claim 22, wherein said piercing member includes a generally longitudinally extending external channel establishing fluid communication between said first and second containers through said fluid transfer valve member.

26. The resealable transfer set defined in claim 22, wherein said transfer set includes a generally tubular luer connector member generally surrounding said fluid transfer valve member having a first proximate open end portion mounted on said first container and a second open distal end portion adjacent said generally closed portion of said fluid transfer valve member having a luer threaded portion.

27. The resealable transfer set defined in claim 26, wherein said generally closed portion of said fluid transfer valve member includes a generally radial annular lip portion overlying a distal end portion of said generally tubular luer connector member retaining and supporting a distal end of said fluid transfer valve member on said first container.

* * * * *